United States Patent [19]

Takemoto

[11] Patent Number: 4,619,536

[45] Date of Patent: Oct. 28, 1986

[54] PRINTING HAMMER ASSEMBLY

[75] Inventor: Takeshi Takemoto, Yamato, Japan

[73] Assignee: Ricoh Company, Ltd., Japan

[21] Appl. No.: 536,906

[22] Filed: Sep. 28, 1983

[30] Foreign Application Priority Data

Sep. 29, 1982 [JP] Japan ..... 57-170703

[51] Int. Cl.[4] ..... B41J 9/38; B41J 9/42

[52] U.S. Cl. ..... 400/157.2; 101/93.48; 400/144.2

[58] Field of Search ..... 400/144.2, 157.2, 157.3; 101/93.29, 93.02, 93.31, 93.33, 93.34, 93.48

[56] References Cited

U.S. PATENT DOCUMENTS

| | | | |
|---|---|---|---|
| 3,675,172 | 7/1972 | Petusky | 101/93.02 X |
| 3,897,867 | 8/1975 | Smith, Jr. | 198/37 |
| 4,024,588 | 5/1977 | Junssen et al. | 3/1.91 |
| 4,239,401 | 12/1980 | Veale | 400/144.2 |
| 4,336,496 | 6/1982 | Schnabl et al. | 324/158 P |
| 4,363,217 | 12/1982 | Venuti | 62/55.5 |

FOREIGN PATENT DOCUMENTS

| | | | |
|---|---|---|---|
| 8660 | 3/1980 | European Pat. Off. | 101/93.48 |
| 2704123 | 8/1977 | Fed. Rep. of Germany | 400/157.2 |
| 2839024 | 3/1979 | Fed. Rep. of Germany | 400/157.2 |
| 11260 | 2/1981 | Japan | 400/157.2 |

*Primary Examiner*—Edgar S. Burr
*Assistant Examiner*—Moshe I. Cohen
*Attorney, Agent, or Firm*—Guy W. Shoup

[57] ABSTRACT

A printing hammer assembly for use in impact printers includes a printing hammer which has an impact surface and an armature and which is supported to be movable in a reciprocating manner along its longitudinal axis, a driving solenoid which drives to move the printing hammer forward when energized against the force of a coil spring which normally applies a biasing force to the printing hammer in the backward direction and a yoke leading a magnetic flux produced by said solenoid to the armature of printing hammer. In the preferred embodiment, a rear end surface of the yoke defines a retracted position of the printing hammer. For this purpose, a stopper member is elastically pressed against the rear end surface of the yoke due to elasticity of a material used or magnetic forces.

16 Claims, 6 Drawing Figures

PRINTING HAMMER ASSEMBLY

BACKGROUND OF THE INVENTION

1. Field of the Invention

This invention generally relates to impact printers, and, in particular, to printing hammer assemblies for use in impact printers.

2. Description of the Prior Art

Impact printers are well known in the art. There are two major categories in impact printers: one category includes line printers which print all of the characters in one printing line at the same time so that printing is carried out line by line and the other category includes serial printers which print characters serially one after another along a printing line. In the latter category, one typical example is a wheel printer which uses a print wheel, sometimes called "daisy wheel", comprised of a hub, a plurality of spokes extending radially from the hub and various types respectively provided at the free ends of the spokes, and an impact hammer for applying an impact force to a selected one of the types upon locating the selected type by rotating the print wheel at a predetermined printing position.

Printing hammer assemblies are employed in various impact hammers, whether serial or line, and it generally includes a printing hammer having an impact surface for applying an impact force to a selected type and a driving solenoid which drives to move the printing hammer forward electromagnetically when energized. In such printing hammer assemblies, their printing hammers are moved back and forth at high frequencies between the home or retracted position and the advanced position where the printing hammer makes contact with a selected type thereby applying an impact force to the selected type to form an imprint on recording paper. Since the impact conditions vary depending upon from where the printing hammer starts its forward movement when driven by the driving coil, it is important that the printing hammer resides at a predetermined home or retracted position at all times before being driven to move for the next printing operation. If there is a relatively large clearance for the home position of the printing hammer, the stroke of movement of the printing hammer will vary thereby causing to deteriorate the quality of printed characters. Thus, it is important to insure that the printing hammer can be returned precisely to the same home position at all times.

One example of a prior art printing hammer assembly applied to a wheel printer using a printing wheel is illustrated in FIG. 1. As shown, the printing hammer assembly includes a printing hammer 1 having a hammer shaft 2 at its forward end and an armature 3 at its backward end, and the printing hammer 1 is supported by a pair of front and rear bearings 4 and 5 so as to be slidably movable in a reciprocating manner linearly. The assembly also includes a front yoke 6 which has a front cylindrical section 6*a* to which the front bearing 4 is fixedly mounted. A driving solenoid 7 is provided as wound around a spool 26 which, in turn, is fixedly mounted as housed in the front yoke 6. The solenoid 7 is so disposed that it can interact with the armature 3 electromagnetically when energized.

A rear yoke 8 is tightly fitted into the rear end of the front yoke 6 and the rear bearing 5 is fixedly attached to the rear yoke 8, and, thus, the front and rear yokes 6 and 8 are so combined to establish a magnetic circuit. Also provided in the assembly is a cover 9 which encloses the front and rear yokes 6 and 8. A rubber damper 10 is disposed as supported by the cover 9 at the location opposite to the rear end of the printing hammer 1, and a metal plate 12, which is a thin rigid member such as a washer, is fixedly attached to the front end surface of the rubber damper 10 thereby defining a retracted end position P by the front end surface of the metal plate 12. As shown in FIG. 1, since a coil spring 11 is provided as extended between the armature 3 of the printing hammer 1 and the front bearing 4, the printing hammer 1 is located at its home or retracted position with its rear end surface abutting against the metal plate 12 when the driving coil 7 is in deenergized state. Also provided in the assembly of FIG. 1 is a protector 32 as fixedly attached at the mouth of the front cylindrical section 6*a*.

In operation, when the driving solenoid 7 is energized, there is produced a magnetic flux passing through the front yoke 6, printing hammer 1 and rear yoke 8 so that the printing hammer 1 is electromagentically driven to move forward against the force of the compression spring 11 as indicated by the arrow A. Thus, the front end, defined as impact surface, of the printing hammer 1 applies an impact force to a selected type 36 of a print wheel 34 located at a predetermined printing position, and, therefore, the type 36 is strongly pressed against recording paper 42 placed around a platen roller 40 with an ink ribbon 38 sandwiched therebetween. Thus, an imprint of the type 36 comes to be formed on the paper 42. Upon deenergization of the solenoid 7, the printing hammer 1 returns to its home position as receiving the recovery force from the spring 1 until its rear end surface hits the washer 12.

The rubber damper 10 is provided for the purpose of absorbing the shock energy of the printing hammer 1 when it returns to its home position with the aid of the recovery force of the spring 11 in order to prevent the printing hammer 1 from rebounding, and it is typically comprised of a low elastic rubber material. A main objective of provision of the washer 12 is to prevent the rear end surface of the printing hammer 1 from being adhered to the front end surface of the rubber damper 10 because the rear end surface of the printing hammer 1 is normally kept pressed against the rubber damper 10 under the force of the spring 11.

However, in the prior art printing hammer assembly as described above, accuracy in positioning the printing hammer 1 at its home position is relatively poor due to several causes. For example, it is rather difficult to precisely control the dimensional accuracy of the rubber damper 10 such as molding accuracy and positioning accuracy. Further, the rubber damper 10 tends to deform due to aging and other environmental conditions thereby causing to shift the retracted position P. Moreover, since rubber is severely affected by deterioration in durability due to aging, performance tends to fluctuate and thus operation is not trustworthy. Such irregularities in retracted position of the printing hammer will produce irregularities in the level and timing of an impact force to be applied to a selected type, and, therefore, resulting imprints will be poor in quality. Such a tendency will be made more noticeable if printing speed is desired to be increased.

SUMMARY OF THE INVENTION

The disadvantages of the prior art as described above are overcome and an improved printing hammer assembly is hereby provided.

Therefore, it is a primary object of the present invention to provide an improved printing hammer assembly.

Another object of the present invention is to provide a printing hammer assembly which may be used advantageously in impact printers.

A further object of the present invention is to provide a printing hammer assembly capable of locating a printing hammer precisely at a predetermined home position at all times.

A still further object of the present invention is to provide a printing hammer assembly which is durable in structure and stable in operation.

A still further object of the present invention is to provide a printing hammer assembly which may be advantageously used in high-speed impact printers without causing any problem such as a deterioration in printing quality.

A still further object of the present invention is to provide a printing hammer assembly which is so structured to be least affected by changes in use or environmental conditions.

A still further object of the present invention is to provide a printing hammer assembly which can absorb the shock energy of the returning hammer effectively almost permanently thereby allowing to prevent the printing hammer from rebounding.

Other objects, advantages and novel features of the present invention will become apparent from the following detailed description of the invention when considered in conjunction with the accompanying drawings.

DESCRIPTION OF THE PREFERRED EMBODIMENTS

Figure 1:
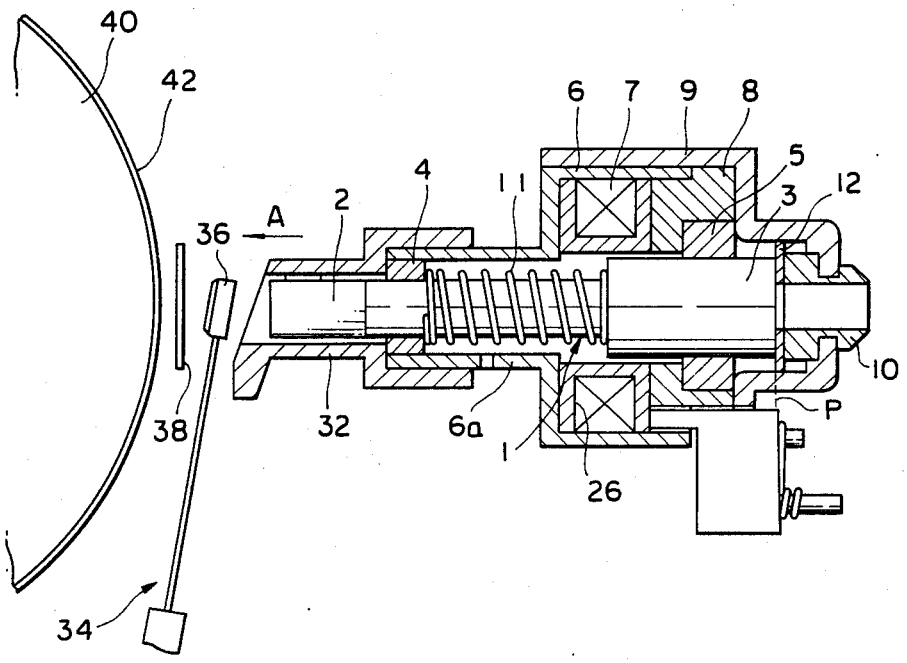
Fig. 1 PRIOR ART
FIG. 1 is a cross-sectional view illustrating a prior art printing hammer assembly when applied to a wheel printer.
Figure 2:
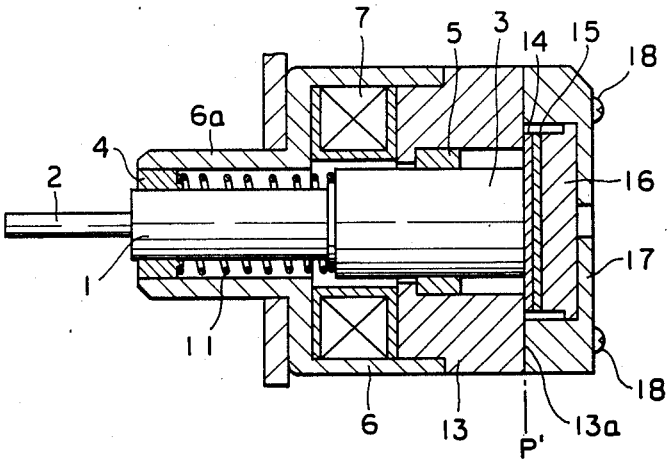
FIG. 2 is a cross-sectional view illustrating one embodiment of the present printing hammer assembly.

Referring now to FIG. 2, there is shown the printing hammer assembly constructed in accordance with one embodiment of the present invention. At the outset, it should be noted that like numerals indicate like elements as practiced throughout the specification, and, thus, those elements shown in FIG. 2 and having the same reference numerals as those elements shown in FIG. 1 are basically identical. As shown in FIG. 2, the overall structure of the present printing hammer assembly is similar to that of the printing hammer assembly shown in FIG. 1. It should, however, be noted that the present printing hammer assembly differs significantly from the assembly of FIG. 1 in the structure of its rear end portion. Described more in detail, the retracted position P' of the printing hammer 1 in the assembly of FIG. 2 is defined by a rear end surface 13*a* of a rear yoke 13. That is, as different from the structure of FIG. 1 in which the retracted position P is defined by the position of the rubber damper 10 itself, in the structure of FIG. 2, the retracted position P' is rather defined by the rear end surface 13*a* of the rear yoke 13.

The rear yoke 13 of FIG. 2 corresponds to the rear yoke 8 of FIG. 1, but the rear yoke 13 of FIG. 2 has its rear end surface 13*a* defined as the retracted position P' for the printing hammer 1. As shown in FIG. 2, a damper member 16 of a low elastic material, which corresponds to the damper 10 in FIG. 1, is provided as received in and partly compressed by a cap-shaped holder 17, which, in turn, is tightly attached to the rear end surface 13*a* of the rear yoke 13 by means of screws 18. A rigid member 14 of an appropriate material such as metal is fixedly attached to the front end surface of the damper member 16 with an intermediate plate 15 sandwiched therebetween. When the holder 17 is tightly attached to the rear yoke 13 by means of the screws 18, the elastic damper 16 becomes slightly compressed to maintain the rigid member 14 pressed against the rear end surface 13*a* thereby allowing to position the front end surface of the rigid member 14 in registry with the defined retracted position P'. The intermediate plate 15 may be made of any appropriate material, and it is provided to reinforce the rigid member 14 thereby preventing the rigid member from being undesirably deflected due to the force of the spring 11.

Such a structure is particularly advantageous because the retracted position P' for the printing hammer 1 may be easily defined and its position may be kept unchanged almost permanently. It should also be noted that maintenance and replacement of parts are easier in the structure of FIG. 2 as compared with the prior art structure shown in FIG. 1.

Figure 3:
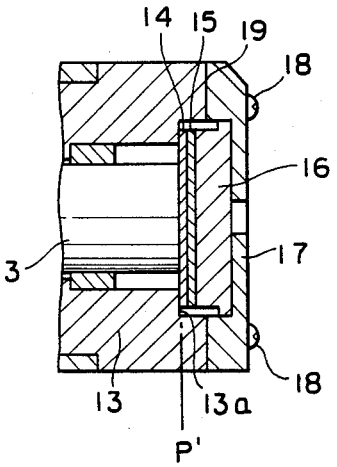
FIGS. 3 and 4 are fragmentary, cross-sectional views illustrating modifications of the printing hammer assembly shown in FIG. 2.

FIG. 3 illustrates a modified structure in which the retraced position P' is defined by a recessed end surface 13*a* which is recessed from the rear end surface of the rear yoke 13 which provides a mounting surface to which the holder 17 is tightly attached by means of the screws 18. In the structure of FIG. 3, the rigid member 14 which comes into contact with the rear end surface of the printing hammer 3 when the hammer 3 is returned to the home position is kept in position as pressed against the recessed end surface 13*a* of the rear yoke 13. This structure is advantageous because it allows to make the assembly compact in size.

Figure 4:
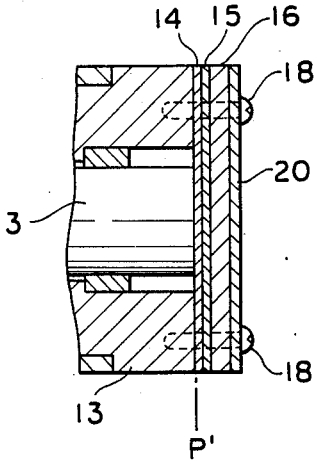

FIG. 4 illustrates another modified structure in which the retracted position P' for the printing hammer 1 is again defined by the rear end surface of the rear yoke 13, but use is made of a plate-shaped holder 20 instead of the cap-shaped holder 17 shown in FIGS. 2 and 3. The embodiment of FIG. 4 is structurally simpler than the before two shown in FIGS. 2 and 3, and, thus, it can be fabricated less expensively, and, yet, still it has the same advantage of positioning the rear end surface of the printing hammer 1 precisely at the predetermined retracted position P' whenever the hammer 1 returns from the advanced position.

As described above, the intermediate plate 15 is a back-up plate for the rigid member 14 and it has a role of preventing the rigid member 14 from undesirably deflecting due to the force applied by the spring 11. However, if desired, the intermediate plate 15 may be discarded. The rigid member 14, intermediate plate 15 and damper 16 are integrated, for example, by adhesives or brazing.

With the above-described structure, the shock energy of the printing hammer 1 in returning motion may be effectively absorbed by the damper 16 thereby preventing the printing hammer 1 from rebounding, and the printing hammer 1 may be located always with its rear end surface in alignment with the predetermined retracted position P' while waiting for the next printing operation even if aging has occurred to the damper 16. It is to be noted that size tolerances for either one of the damper 16, rigid member 14 and intermediate plate 15 do not affect in any manner the precise positioning of the printing hammer 1 at its intended home position in the present invention.

Figure 5:
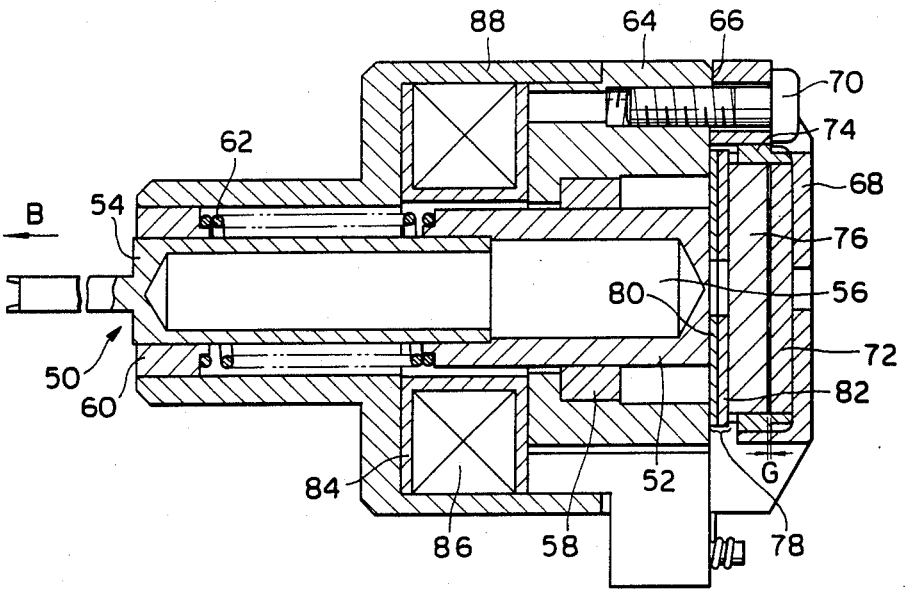
FIG. 5 is a cross-sectional view illustrating another embodiment of the present printing hammer assembly.

Referring now to FIG. 5, there is shown a further embodiment of the present printing hammer assembly which includes a printing hammer 50 comprised of an armature 52 and a hammer shaft 54. The armature 52 is generally cylindrical and it has a center bore 56 opened at its front end. The hammer shaft 54 has its base end tightly fitted into the mouth of the center bore 56 to be concentrically integrated with the armature 52 and its front end machined to present a projection which is rectangular in cross section. Similarly with the previous embodiments, the armature 52 is slidably supported by a rear bearing 58 and the hammer shaft 54 is slidably supported by a front bearing 60 so that the printing hammer 50 may move back and forth along its longitudinal axis. Also provided as loosely fitted onto the hammer shaft 54 and extended between the front shoulder of the armature 52 and the front bearing 60 is a compression coil spring 62 which normally biases the printing hammer 50 backward or to the right in FIG. 5. As will become clear later, any other means such as a magnet may be used to apply such a backward bias to the printing hammer 50.

As described with respect to the previous embodiments, the rear bearing 58 is fixedly mounted as housed in a rear yoke 64 whose rear end surface 66 is defined as a retracted position for the rear end surface of the printing hammer 50. Thus, similarly with the previous cases, a cap-shaped holder 68 is tightly attached to the rear end surface 66 by means of an appropriate number of screws 70. A disc-shaped magnet 72 is fixedly attached, for example, by adhesives to the inner top surface of the cap-shaped holder 68 as shown. A guide ring 74 is also fixedly attached to the holder 68 as fitted onto the disc-shaped magnet 72. And thus the holder 68, magnet 72 and guide ring 74 form an integrated structure. Another disc-shaped magnet 76 is provided with the same polarity facing opposite to that of the fixedly attached magnet 72 as movably received inside of the guide ring 74. The movable disc-shaped magnet 76 is not fixedly attached to anywhere and it is movably received in the guide ring 74, and, thus, it can move toward or away from the stationary disc-shaped magnet 72 as guided by the guide ring 74.

Since the stationary and movable magnets 72 and 76 are so disposed to face their magnetic poles of the same polarity opposed to each other, the movable magnet 76 is normally biased to the forward direction due to the magnetic repulsion between the two magnets 72 and 76. It is to be noted that the movable magnet 76 also receives an additional bias force in the forward direction due to the magnetic attractive force applied by the rear yoke 64. A stopper plate 78 is integrally provided as fixedly attached, for example, by adhesives to the front end surface of the movable magnet 76. The stopper plate 78 in the illustrated example has a composite structure and it is comprised of an adhesion preventing plate 80, for example, of teflon or polyester and a back-up plate 82, for example, of stainless steel. These two plates 80 and 82 are fixedly attached to each other and such a combined structure is then fixedly attached to the front end surface of the movable magnet 76. As mentioned before, since the movable magnet 76 having the integrated stopper plate 78 at its front end receives a bias force in the forward direction, the movable magnet 76 is normally held in position with the front end surface of the stopper plate 78 in abutment against the rear end surface of the rear yoke 64 or in alignment with the intended retracted position. Under the condition, the remaining front end surface of the stopper plate 78 receives the rear end surface of the printing hammer 50 to keep it in home position. Accordingly, the combined bias force applied to the movable magnet 76 in the forward direction must be sufficiently stronger than the recovery force of the spring 62. It is further to be noted that there is formed a small gap G between the stationary and movable magnets 72 and 76 when the movable magnet 76 is so located with the front end surface of the integrated stopper plate 78 abutted against the rear end surface 66 of the rear yoke 64.

In front of the rear yoke 64 is disposed a spool 84 around which is provided as wound a driving solenoid 86, which, in turn, is energized or deenergized in accordance with a printing signal supplied from a print control circuit ( not shown ). The spool 84, together with the solenoid 86, is tightly fitted into a front yoke 88 which is generally cylindrical in shape. The front yoke 88 is also tightly fitted onto the rear yoke 64 thereby forming an integrated yoke structure. Similarly with the previous embodiments, the front yoke 88 has a front cylindrical section and the front bearing 60 is fixedly mounted at the mouth of the front cylindrical section.

In operation, when the driving solenoid 86 is energized, there is produced a magnetic flux which passes through the front yoke 88, armature 52, rear yoke 64, so that the printing hammer 50 receives a driving force directed in the forward direction and thus it moves in the direction indicated by the arrow B against the force of the spring 62. At the end of such a forward stroke of movement, the printing hammer 50 applies an impact force on a selected type located at a predetermined printing position thereby forming an imprint of the selected type on recording paper. When the solenoid 86 is deenergized, the printing hammer 50 is electromagnetically decoupled from the solenoid 86 and thus it starts to move in the backward direction which is opposite to the direction B under the recovery force of the spring 62 and the reactive force applied to the printing hammer 50 at the time of impact with the selected type. At the end of this returning stroke, the rear end surface of the printing hammer 50 strikes the stopper plate 78, and the shock energy in this instance is absorbed by the combined bias force acting on the movable magnet 76 in the forward direction as described previously. That is, the impact force at the end of the returning stroke is counteracted by the combined bias force, which is a combination of a magnetic repulsive force between the stationary and movable magnets 72 and 76 and a magnetic attractive force between the movable magnet 76 and the rear yoke 64.

Figure 6:
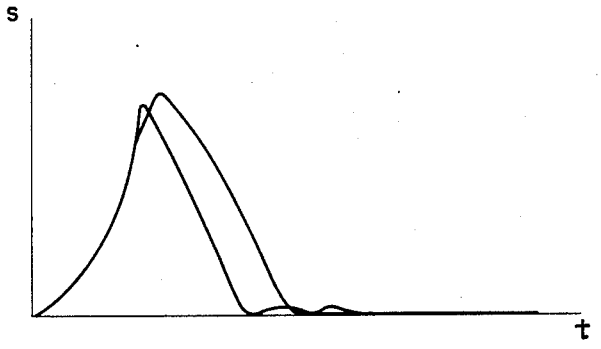
FIG. 6 is a graph useful for explaining how significantly the amount of rebound of the printing hammer of the assembly shown in FIG. 5 is decreased.

FIG. 6 is a graph showing the time-dependent movement of the printing hammer 50 in the assembly shown in FIG. 5, in which the ordinate is taken for the stroke s of movement of the printing hammer 50 and the abscissa is taken for time t. In each of the curves shown in FIG. 6, the first peak indicates the stroke of reciprocating movement of the printing hammer 50 for impacting a selected type to form an imprint and the second extremely small peak indicates rebounding motion of the hammer 50. As may be easily appreciated from the measured results shown in the graph of FIG. 6, the shock energy at the end of the returning motion is effectively absorbed and thus there is very little rebound when the rear end surface of the printing hammer 50 strikes the stopper plate 78. Actual data indicated the amount of rebound to be in the order of 0.05–0.15 mm, which is practically negligible, and it has also been found that no appreciable changes in the amount of rebound take place in the temperature range between 0° and 45°.

As a modified structure, use may be made of a tension spring instead of the compression spring 62 in order to apply a bias force to the printing hammer 50 in the backward direction. Furthermore, a stopper section, which strikes the stopper plate 78, may be provided as a recessed end surface or as a stepped portion somewhere along the outer peripheral surface of the printing hammer 50 instead of providing as the rear end surface of the printing hammer 50 as in the structure shown in FIG. 5. It should also be noted that the stopper plate 78 may be comprised of a single plate instead of a composite structure shown in FIG. 5, and, in addition, the stopper plate 78 may be totally discarded, if desired. Further, the retracted position is defined by the rear end surface 66 of the rear yoke 64 in the illustrated embodiment; however, this retracted position may be defined as a recessed end surface as shown in the previous embodiments or by any other element of the assembly.

In the embodiment illustrated in FIG. 5, provision is made of the guide ring 74 for guiding the movement of the movable magnet 76; however, such a guide ring 74 may be formed by a part of the holder 68. In this case, it is not necessary to provide the guide ring 74. It should further be noted that the stationary magnet 72 is disposed in the rear side of the movable magnet 76 with their magnetic poles of like polarity opposite to each other in the illustrated embodiment of FIG. 5; however, one or more such stationary magnets, preferably in the shape of a ring or a plurality of small magnets arranged in the form of a circle, may be provided in the front side of the movable magnet 76 such that they are in magnetically attractive relation so as to keep the movable magnet 76 aligned at the intended retracted position.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A printing hammer assembly comprising:

a printing hammer having an impact surface and a magnetically interacting means;

means for supporting said printing hammer slidably movable along the longitudinal axis of said printing hammer;

biasing means for normally biasing said printing hammer in a backward direction along said longitudinal axis to a retracted position;

means for producing a magnetic flux passing through said magnetically interacting means of said printing hammer when energized, thereby causing said printing hammer to move in a forward direction along said longitudinal axis against the bias force of said biasing means;

means for providing a first surface which defines said retracted position of said printing hammer, said means for providing a first surface including a rear yoke having a rear end surface at least a part of which defines said first surface facing in said backward direction with respect to the return movement of said printing hammer along said longitudinal axis to said retracted position;

stopper means normally pressed against said first surface and having a second surface normally located in registry with said first surface, said second surface being contactable with said printing hammer to position said printing hammer at said retracted position; and means for holding said stopper means normally pressed against said first surface.

2. An assembly of claim 1 wherein said first surface is a rigid surface generally annular in shape and said stopper means is larger in diameter than said annular-shaped first surface.

3. An assembly of claim 1 wherein said magnetically interacting means includes an armature provided at the rear end of said hammer and said impact surface is defined at the forward end of said hammer.

4. An assembly of claim 3 wherein said means for supporting includes a pair of front and rear bearings fixedly mounted as spaced apart from each other over a predetermined distance and said printing hammer is slidably supported by said pair of front and rear bearings so as to be reciprocatingly movable along its longitudinal axis.

5. An assembly of claim 4 further comprising a front yoke to which said front bearing is fixedly mounted, wherein said rear yoke is integrally formed with said front yoke and said rear bearing is fixedly mounted to said rear yoke.

6. An assembly of claim 5 wherein said first surface is a recessed surface.

7. An assembly of claim 4 wherein said biasing means includes a compression spring extended between said front bearing and said armature thereby exerting a biasing force to said printing hammer in the backward direction.

8. An assembly of claim 5 wherein said means for producing includes a solenoid fixedly mounted as interposed between said front and rear yokes.

9. An assembly of claim 1 wherein said stopper means includes a shock-absorbing disc having a front surface and comprised of a low elastic material for absorbing the shock energy of said printing hammer when it strikes at the end of its returning stroke, thereby allowing to prevent said printing hammer from rebounding.

10. An assembly of claim 9 wherein said stopper means further includes a first plate fixedly attached to the front surface of said shock-absorbing disc, said first plate being comprised of a rigid material and presenting a contact surface to which a rear end surface of said printing hammer comes into contact.

11. An assembly of claim 10 wherein said stopper means further includes a second plate fixedly provided as sandwiched between said disc and said first plate, said second plate reinforcing said first plate.

12. An assembly of claim 1 wherein said stopper means is movably provided and includes a first magnet and said holding means includes a second magnet, whereby said first and second magnets are disposed in a magnetically repulsive relation thereby causing said stopper means to be pressed against said first surface with a small gap defined between said stopper means and said second magnet.

13. An assembly of claim 12 wherein said stopper means further includes a stopper plate fixedly mounted at the front surface of said first magnet, said stopper plate being contactable with said first surface.

14. An assembly of claim 13 wherein said stopper plate is a composite plate comprised of an adhesion prevention plate component and a back-up plate component which is integral with said adhesion prevention plate component.

15. An assembly of claim 14 wherein said adhesion prevention plate component is comprised of a material selected from the group consisting of teflon and polyester and said back-up plate component is comprised of stainless steel.

16. An assembly of claim 12 wherein said holding means further includes a guide ring for guiding the movement of said stopper means.

* * * * *